US007114559B2

(12) United States Patent
Sonnier et al.

(10) Patent No.: US 7,114,559 B2
(45) Date of Patent: Oct. 3, 2006

(54) METHOD OF REPAIR OF COLLAPSED OR DAMAGED TUBULARS DOWNHOLE

(75) Inventors: James A. Sonnier, Houston, TX (US); John L. Baugh, Houston, TX (US); Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 223 days.

(21) Appl. No.: 10/359,759

(22) Filed: Feb. 6, 2003

(65) Prior Publication Data

US 2003/0155118 A1 Aug. 21, 2003

Related U.S. Application Data

(60) Provisional application No. 60/356,061, filed on Feb. 11, 2002.

(51) Int. Cl.
*E21B 23/02* (2006.01)
*B21D 41/02* (2006.01)

(52) U.S. Cl. ..... 166/206; 166/212; 72/393

(58) Field of Classification Search ..... 166/206, 166/207, 217, 382, 384, 212, 216; 72/370.01, 72/370.06, 370.08, 380, 393; 29/522.1, 523
See application file for complete search history.

(56) References Cited

U.S. PATENT DOCUMENTS

| | | | | |
|---|---|---|---|---|
| 180,169 | A * | 7/1876 | Tasker | 279/2.13 |
| 556,718 | A | 3/1896 | Semmer | |
| 2,694,376 | A * | 11/1954 | Hauser | 269/48.1 |
| 2,877,822 | A | 3/1959 | Buck | |
| 3,191,677 | A | 6/1965 | Kinley | |
| 3,354,969 | A | 11/1967 | Ebeling | |
| 3,508,610 | A | 4/1970 | Kisling, III | |
| 3,664,416 | A | 5/1972 | Nicholas et al. | |
| 3,776,307 | A | 12/1973 | Young | |
| 3,785,193 | A * | 1/1974 | Kinley et al. | 72/393 |
| RE28,449 | E | 6/1975 | Edmond | |
| 3,948,321 | A | 4/1976 | Owen et al. | |
| 4,095,655 | A | 6/1978 | Still | |
| 4,262,518 | A * | 4/1981 | Creger et al. | 72/393 |
| 4,311,196 | A * | 1/1982 | Beall et al. | 166/134 |
| 5,141,053 | A | 8/1992 | Restarick et al. | |
| 5,348,095 | A | 9/1994 | Worrall et al. | |
| 5,366,012 | A | 11/1994 | Lohbeck | |
| 5,623,991 | A | 4/1997 | Jani | |
| 5,667,011 | A | 9/1997 | Gill et al. | |
| 5,785,120 | A | 7/1998 | Smalley et al. | |
| 5,794,703 | A | 8/1998 | Newman et al. | |
| 5,901,789 | A | 5/1999 | Donnelly et al. | |
| 5,960,895 | A | 10/1999 | Chevallier et al. | |
| 6,012,523 | A | 1/2000 | Campbell et al. | |

(Continued)

FOREIGN PATENT DOCUMENTS

EP 0370591 A2 5/1990

(Continued)

*Primary Examiner*—Kenneth Thompson
(74) *Attorney, Agent, or Firm*—Steve Rosenblatt

(57) ABSTRACT

A method of repairing tubulars downhole is described. A swage is secured to a force magnification tool, which is, in turn, supported by an anchor tool. Applied pressure sets the anchor when the swage is properly positioned. The force magnification tool strokes the swage through the collapsed section. The anchor can be released and weight set down on the swage to permit multiple stroking to get through the collapsed area. The swage diameter can be varied.

17 Claims, 19 Drawing Sheets

U.S. PATENT DOCUMENTS

| | | | | |
|---|---|---|---|---|
| 6,021,850 | A | 2/2000 | Wood et al. | |
| 6,029,748 | A | 2/2000 | Forsyth et al. | |
| 6,070,671 | A | 6/2000 | Cumming et al. | |
| 6,263,966 | B1 | 7/2001 | Haut et al. | |
| 6,315,040 | B1 | 11/2001 | Donnelly | |
| 6,325,148 | B1 | 12/2001 | Trahan et al. | |
| 6,450,261 | B1 | 9/2002 | Baugh | |
| 6,622,789 | B1 * | 9/2003 | Braddick | 166/277 |
| 2004/0168796 | A1 * | 9/2004 | Baugh et al. | 166/207 |

FOREIGN PATENT DOCUMENTS

| | | | |
|---|---|---|---|
| GB | 23461658 | A | 8/2000 |

* cited by examiner

METHOD OF REPAIR OF COLLAPSED OR DAMAGED TUBULARS DOWNHOLE

PRIORITY INFORMATION

This application claims the benefit of U.S. Provisional Application No. 60/356,061 on Feb. 11, 2002.

FIELD OF THE INVENTION

The field of this invention relates to techniques for repair of collapsed or otherwise damaged tubulars in a well.

BACKGROUND OF THE INVENTION

At times, surrounding formation pressures can rise to a level to actually collapse well casing or tubulars. Other times, due to pressure differential between the formation and inside the casing or tubing, a collapse is also possible. Sometimes, on long horizontal runs, the formation surrounding the tubulars in the well can shift in such a manner as to kink or crimp the tubulars to a sufficient degree to impede production or the passage of tools downhole. Past techniques to resolve this issue have been less than satisfactory as some of them have a high chance of causing further damage, while other techniques were very time consuming, and therefore expensive for the well operator.

One way in the past to repair a collapsed tubular downhole was to run a series of swages to incrementally increase the opening size. These tools required a special jarring tool and took a long time to sufficiently open the bore in view of the small increments in size between one swage and the next. Each time a bigger swage was needed, a trip out of the hole was required. The nature of this equipment required that the initial swage be only a small increment of size above the collapsed hole diameter. The reason that small size increments were used was the limited available energy for driving the swage using the weight of the string in conjunction with known jarring tools. Tri-State Oil Tools, now a part of Baker Hughes Incorporated, sold casing swages of this type.

Also available from the same source were tapered mills having an exterior milling surface known as Superloy. These tapered mills were used to mill out collapsed casing, dents, and mashed in areas. Unfortunately, these tools were difficult to control with the result being an occasional unwanted penetration of the casing wall. In the same vein and having similar problems were dog leg reamers whose cutting structures not only removed the protruding segments but sometimes went further to penetrate the wall.

What is needed and is an object of the invention is a method and apparatus to allow repair of collapsed or bent casing or tubulars in a single trip using an expansion device capable of delivering the desired final internal dimension. The method features anchoring the device adjacent the target area, using a force multiplier to obtain the starting force for expansion, and stoking the swage as many times as necessary to complete the repair. These and other advantages of the present invention will become clearer to those skilled in the art from a review of the detailed description of the preferred embodiment and the claims below.

SUMMARY OF THE INVENTION

A method of repairing tubulars downhole is described. A swage is secured to a force magnification tool, which is, in turn, supported by an anchor tool. Applied pressure sets the anchor when the swage is properly positioned. The force magnification tool strokes the swage through the collapsed section. The anchor can be released and weight set down on the swage to permit multiple stroking to get through the collapsed area. The swage diameter can be varied.

BRIEF DESCRIPTION OF THE DRAWINGS

FIG. 8 is a perspective view of the adjustable swage during run in;

DETAILED DESCRIPTION OF THE PREFERRED EMBODIMENT

Figure 1A:
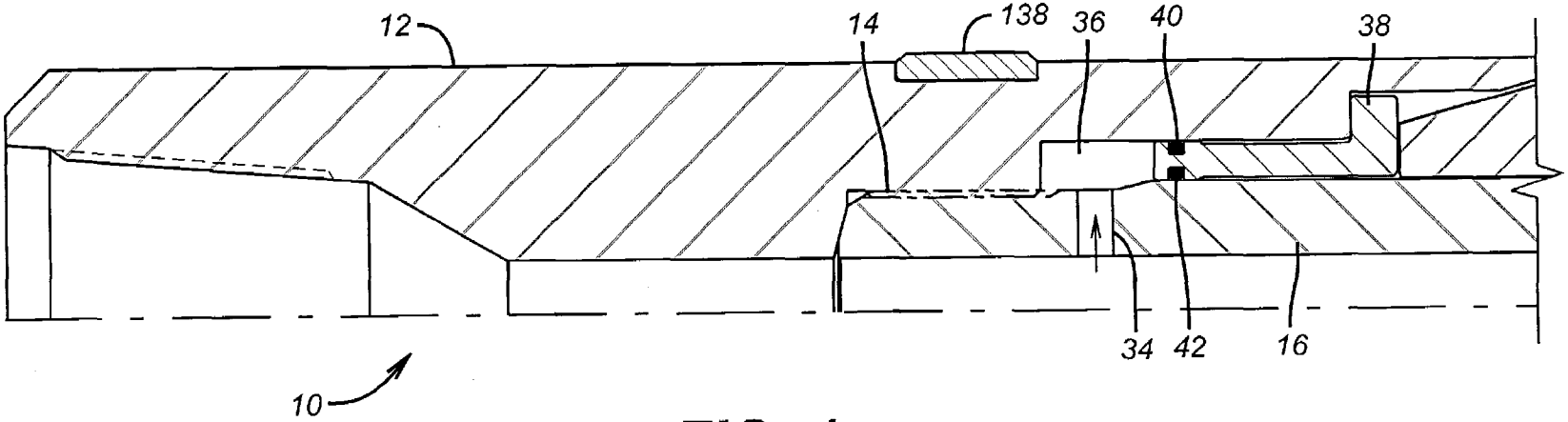
FIGS. 1*a*–1*d* show the anchor in the run in position.
Figure 2A:
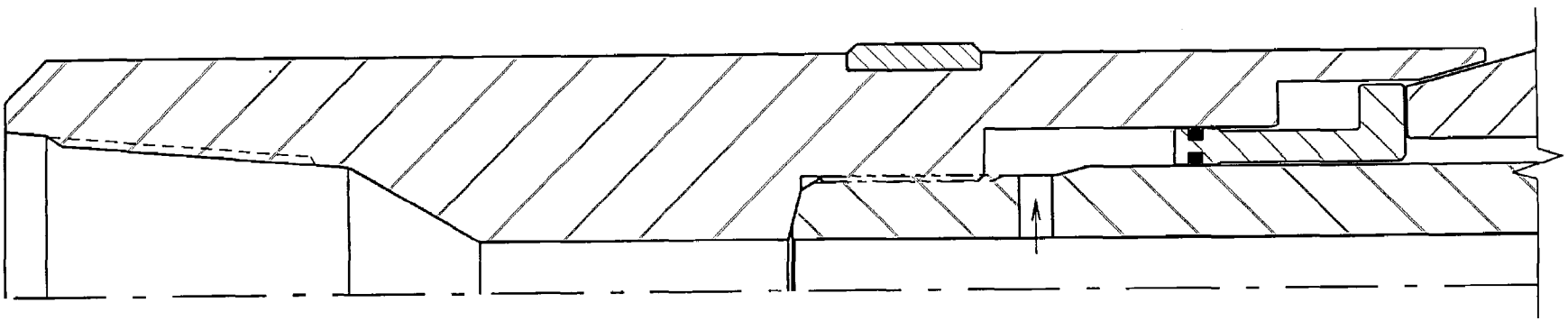
FIGS. 2*a*–2*d* show the anchor in the set position.
Figure 1B:
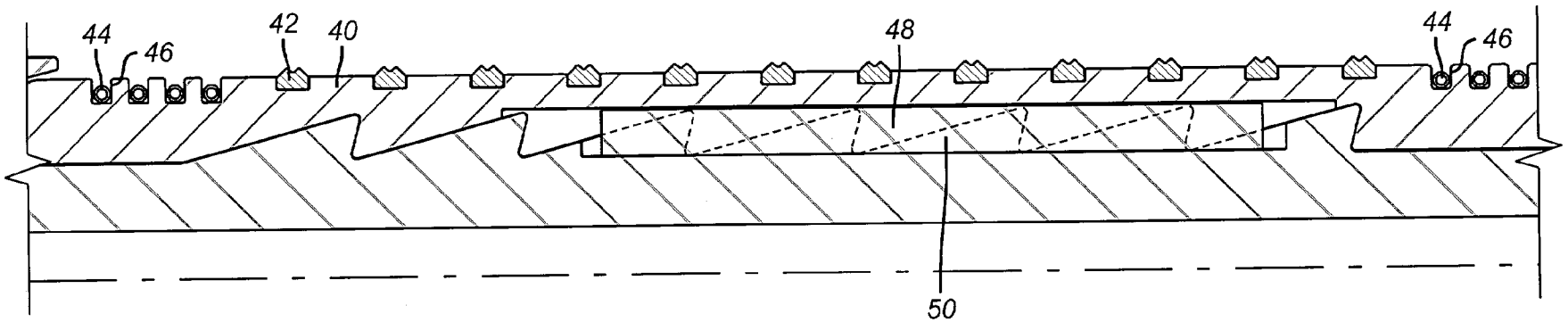
Figure 2B:
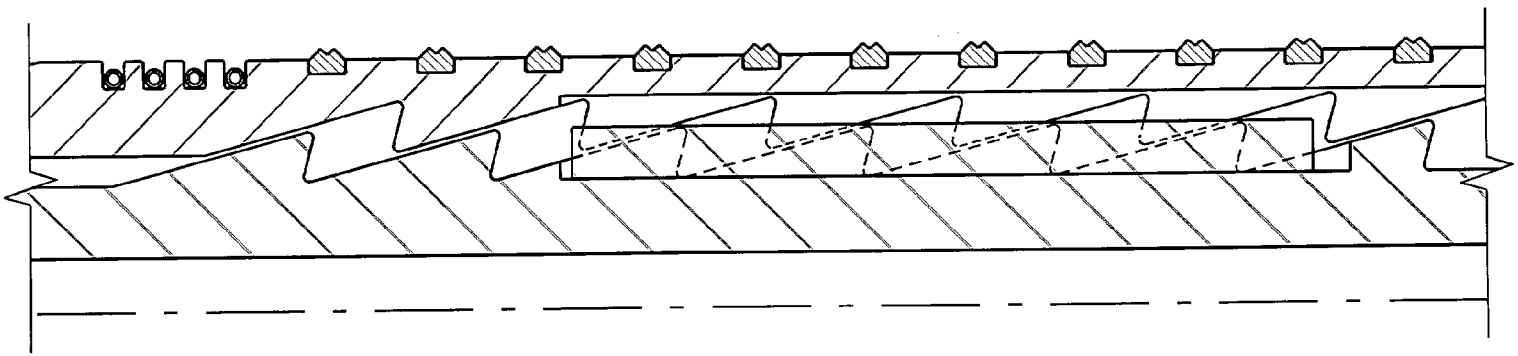
Figure 1C:
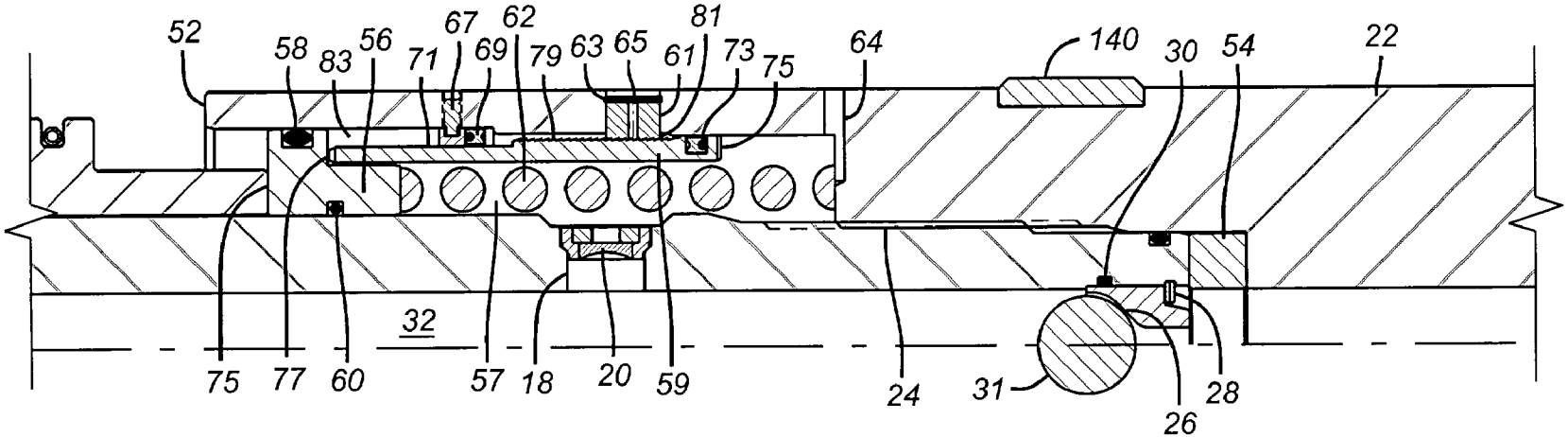
Figure 2C:
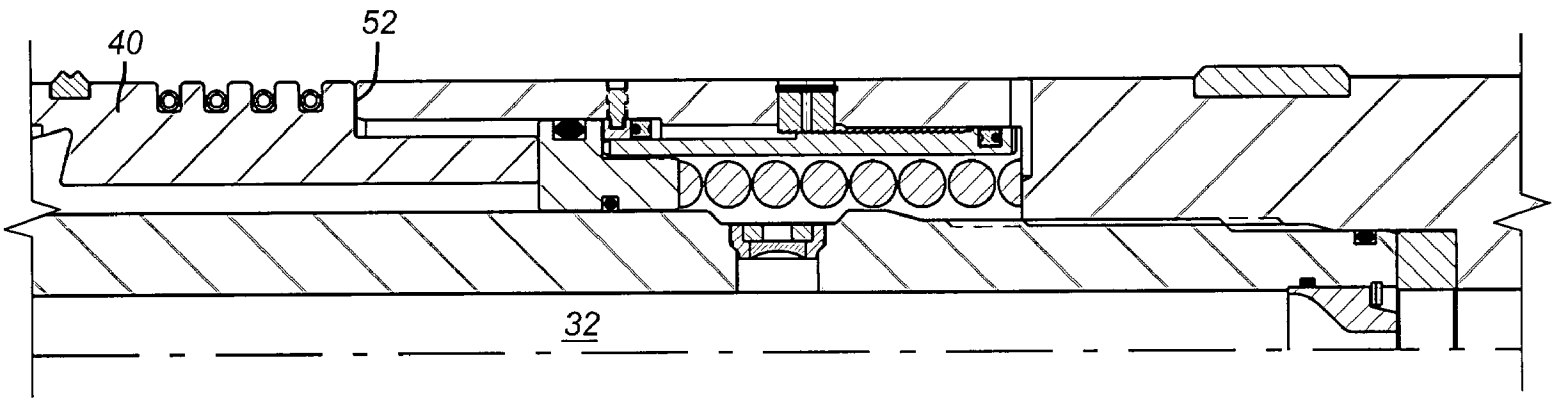
Figure 1D:
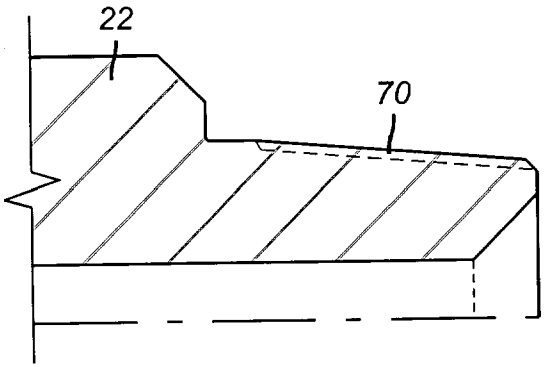
Figure 2D:
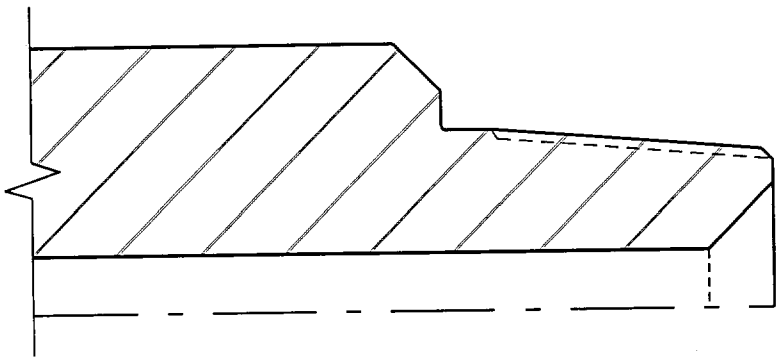
Figure 3A:
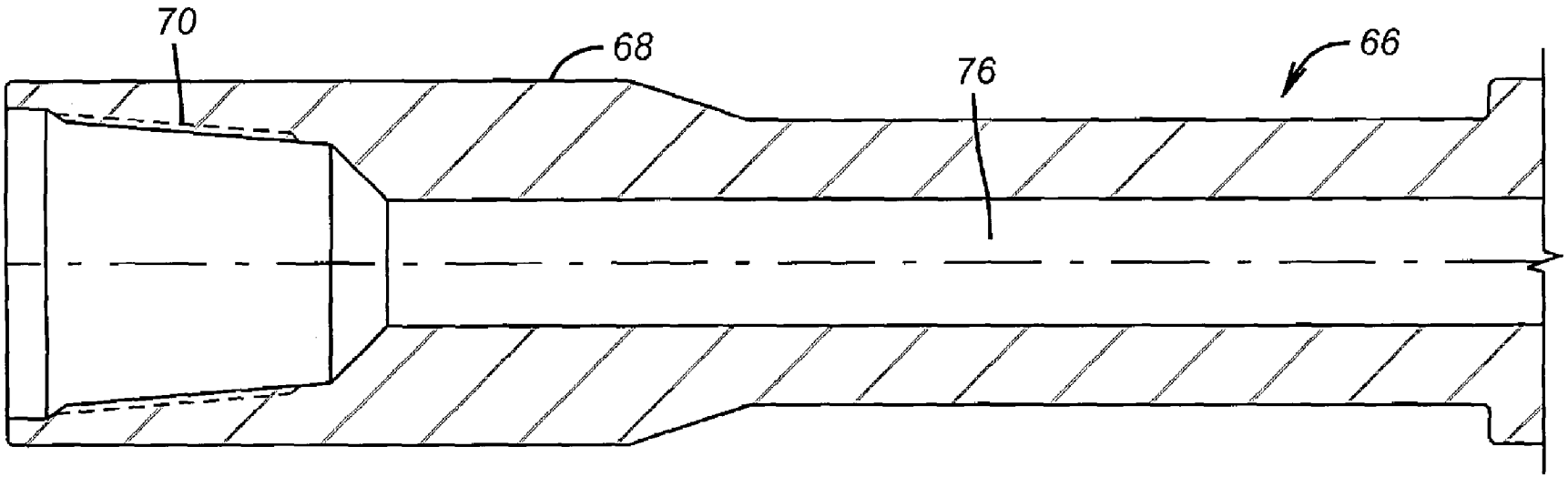
FIGS. 3*a*–3*e* show the force magnification tool in the run in position.
Figure 3B:
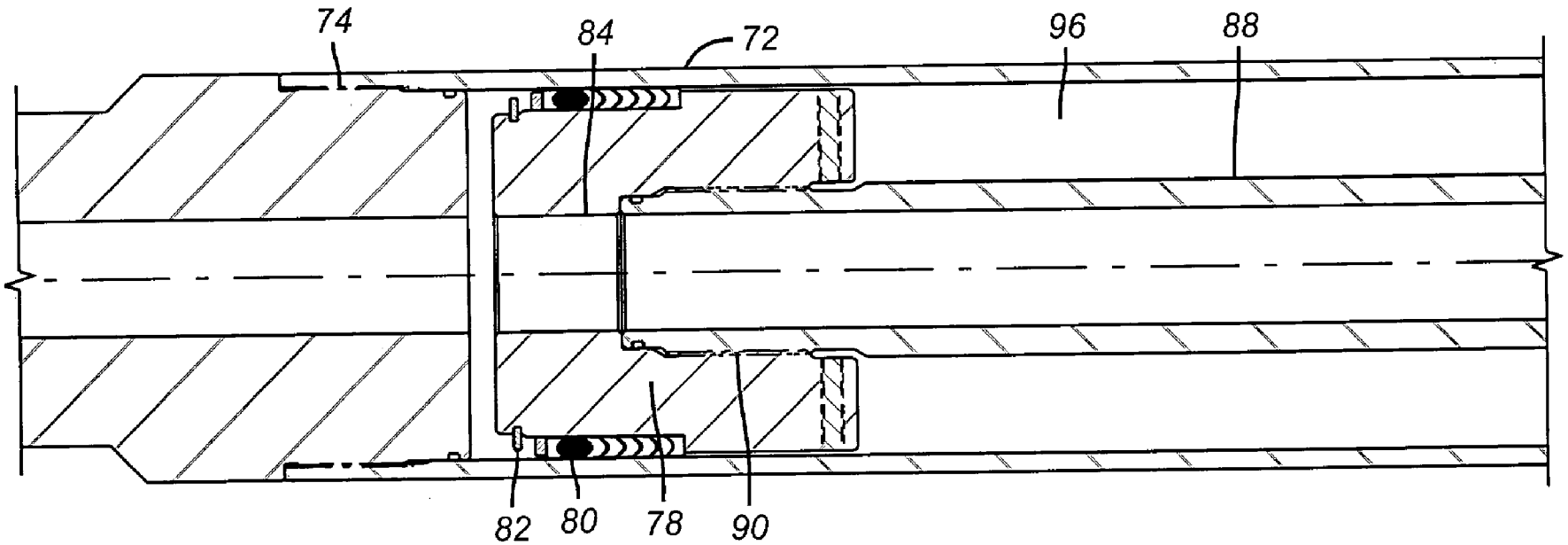
Figure 3C:
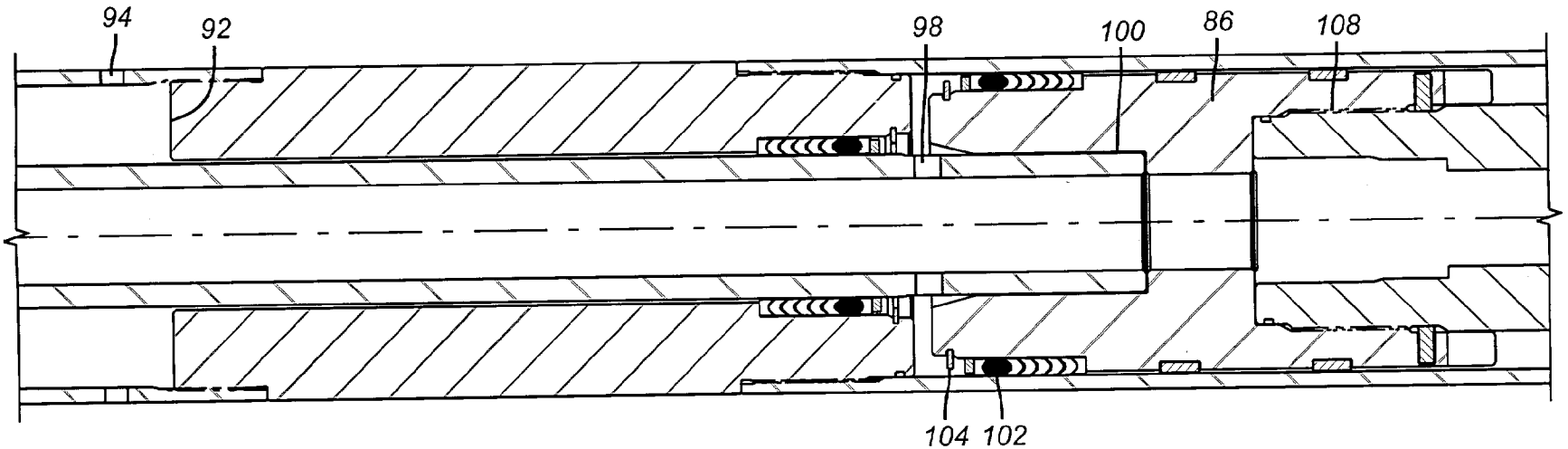
Figure 3D:
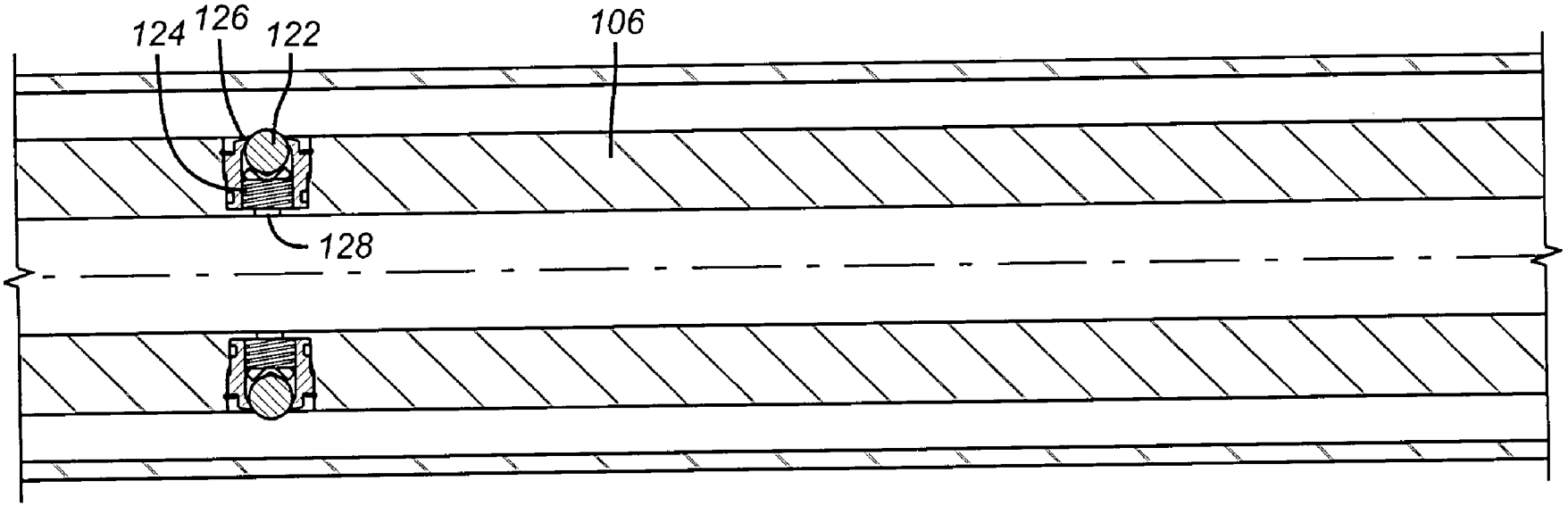
Figure 3E:
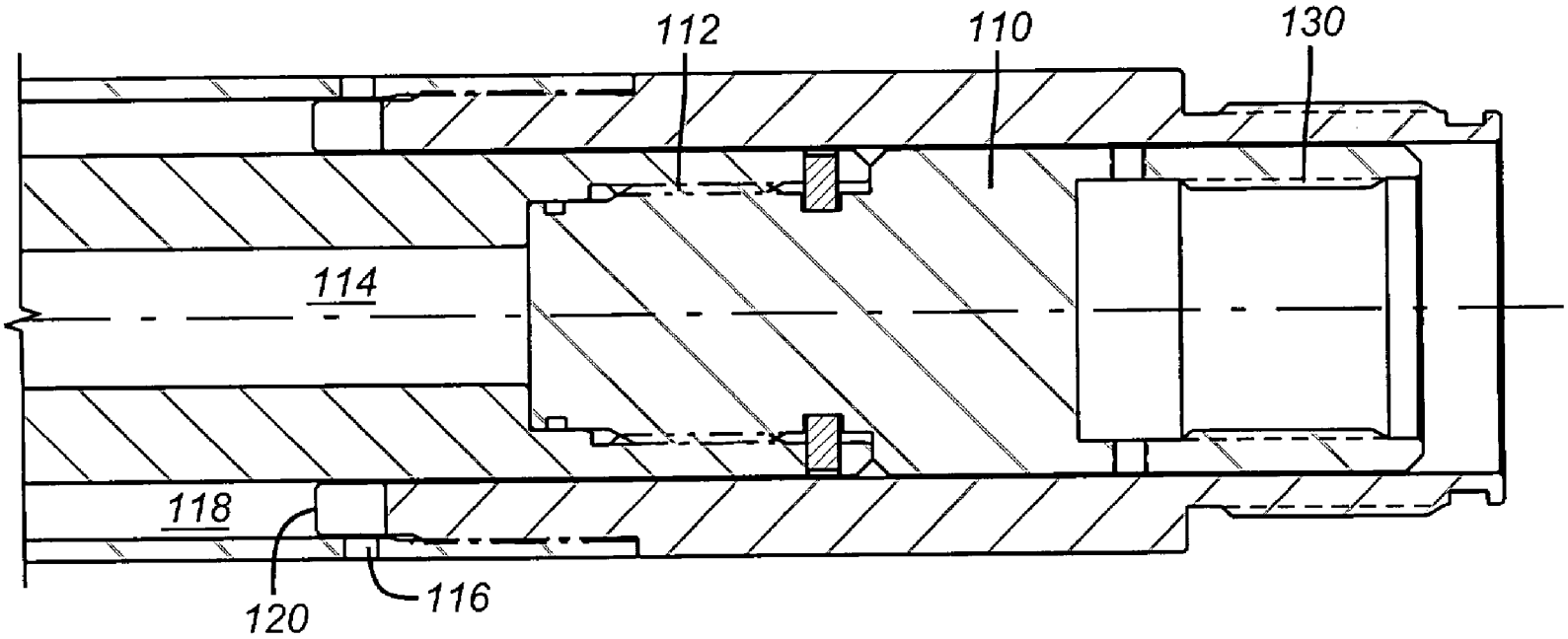

Referring to FIG. 1*a*, the anchor 10 has a top sub 12, which is connected at thread 14 to body 16. A rupture disc 20 closes off a passage 18. At its lower end, the body 16 is connected to bottom sub 22 at thread 24. Body 16 supports a seat 26 with at least one snap ring 28. A seal 30 seals between body 16 and seat 26. The purpose of seat 26 is to receive a ball 31 (FIG. 1C) to allow pressure buildup in passage 32 to break rupture disc 20, if necessary. A passage 34 communicates with cavity 36 to allow pressure in passage 32 to reach the piston 38. Seals 40 and 42 retain the pressure in cavity 36 and allow piston 38 to be driven downwardly. Piston 38 bears down on a plurality of gripping slips 40, each of which has a plurality of carbide inserts or equivalent gripping surfaces 42 to bite into the casing or tubular. The slips 40 are held at the top and bottom to body 16 using band springs 44 in grooves 46. The backs of the slips 40 include a series of ramps 48 that ride on ramps 50 on body 16. Downward, and by definition outward movement of the slips 40 is limited by travel stop 52 located at the end of bottom sub 22. FIG. 2 shows the travel stop 52 engaged by slips 40. The thickness of a spacer 54 can be used to adjust the downward and outward travel limit of the slips 40.

Located below the slips 40 is closure piston 56 having seals 58 and 60 and biased by spring 62. A passage 64 allows fluid to escape as spring 62 is compressed when the slips 40 are driven down by pressure in passage 34. Closure piston 56 is located in chamber 57 with ratchet piston 59. A ratchet plug 61 is biased by a spring 63 and has a passage 65 though it. A dog 67 holds a seal 69 in position against surface 71 of ratchet piston 59. A seal 73 seals between piston 59 and bottom sub 22. Area 75 on piston 59 is greater than area 77 on the opposite end of piston 59. In normal operation, the ratchet piston 59 does not move. It is only when the slips 40 refuse to release and rupture disc 20 is broken, then pressure drives up both pistons 56 and 59 to force the slips 40 to release and the ratchet teeth 79 and 81 engage to prevent downward movement of piston 56. Passage 65 allows fluid to be displaced more rapidly out of chamber 83 as piston 59 is being forced up.

Figure 4:
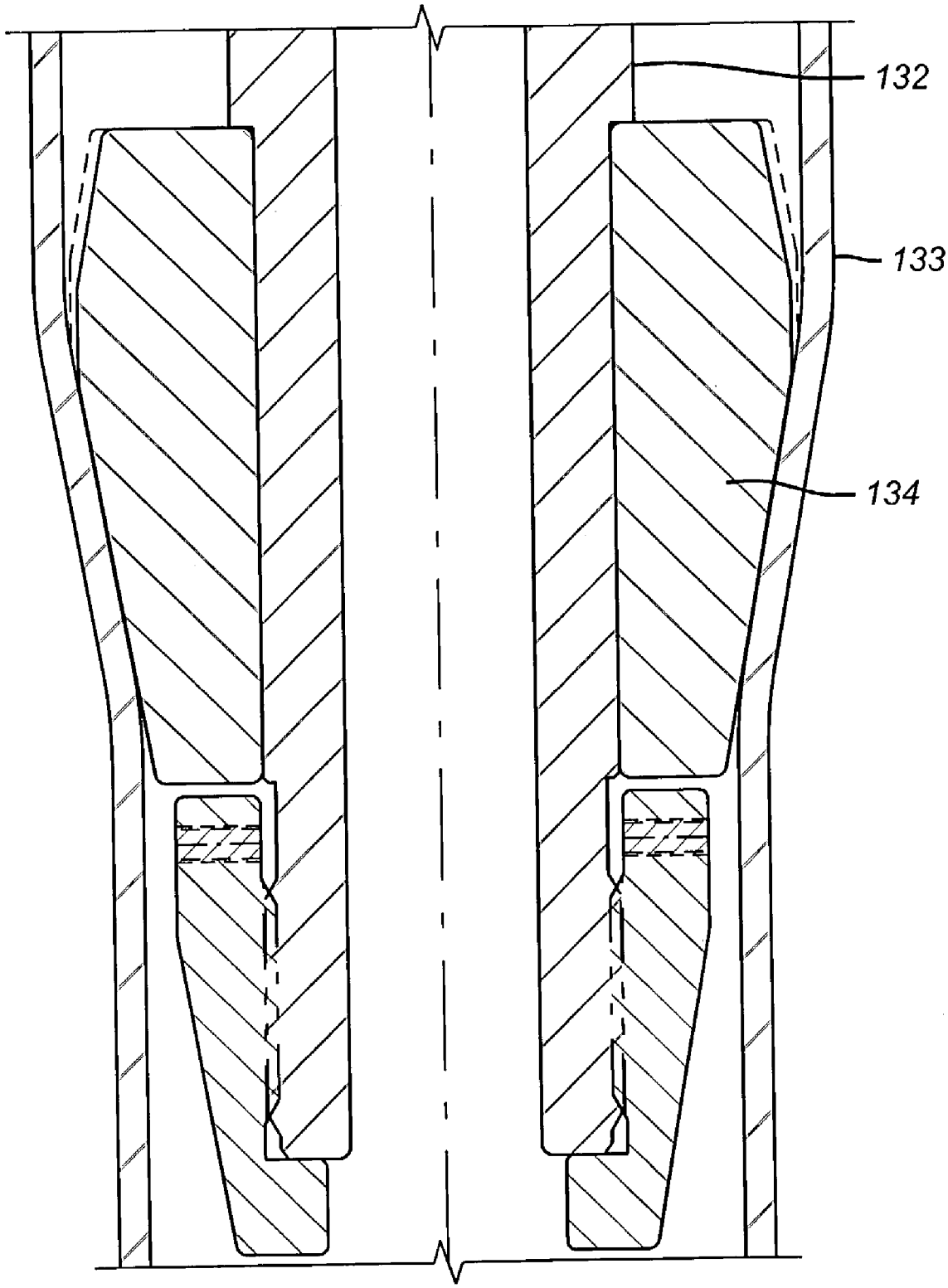
FIG. 4 is a swage that can be attached to the force magnification tool of FIGS. 3*a*–3*e*.

Referring now to FIG. 3, the pressure-magnifying tool 66 has a top sub 68 connected to bottom sub 22 of anchor 10 at thread 70. A body 72 is connected at thread 74 to top sub 68. A passage 76 in top sub 68 communicated with passage 32 in anchor 10 to pass pressure to upper piston 78. A seal 80 is retained around piston 78 by a snap ring 82. Piston 78 has a passage 84 extending through it to provide fluid communication with lower piston 86 through tube 88 secured to piston 78 at thread 90. Shoulder 92 is a travel stop for piston 78 while passage 94 allows fluid to move in or out of cavity 96 as the piston 78 moves. Tube 88 has an outlet 98 above its lower end 100, which slidably extends into lower piston 86. Piston 86 has a seal 102 held in position by a snap ring 104. Tube 106 is connected at thread 108 to piston 86. A lower sub 110 is connected at thread 112 to tube 106 to effectively close off passage 114. Passage 114 is in fluid communication with passage 76. Passage 116 allows fluid to enter or exit annular space 118 on movements of piston 86. Shoulder 120 on lower sub 110 acts as a travel stop for piston 86. A ball 122 is biased by a spring 124 against a seat 126 to seal off passage 128, which extends from passage 114. As piston 86 reaches its travel limit, ball 122 is displaced from seat 126 to allow pressure driving the piston 86 to escape just as it comes near contact with its travel stop 120. Thread 130 allows swage body 132 (see FIG. 4) to be connected to pressure magnifying tool 66.

The illustrated swage 134 is illustrated schematically and a variety of devices are attachable at thread 130 to allow the repair of a bent or collapsed tubular or casing 136 by an expansion technique.

The operation of the tool in the performance of the service will now be explained. The assembly of the anchor 10, the force magnifying tool 66 and the swage 134 are placed in position adjacent to where the casing or tubular is damaged. Pressure applied to passage 32 reaches piston 38, pushing it and slips 40 down with respect to body 16. Ramps 48 ride down ramps 50 pushing the slips 40 outwardly against the return force of band springs 44. Inserts 42 bite into the casing or tubing and eventually slips 40 hit their travel stop 52. Piston 56 is moved down against the bias of spring 62. The pressure continues to build up after the slips 40 are set, as shown in FIG. 2. The pressure applied in passage 76 of pressure magnification tool 66 forces pistons 78 and 86 to initially move in tandem. This provides a higher initial force to the swage 134, which tapers off after the piston 78 hits travel stop 92. Once the expansion with swage 134 is under way, less force is necessary to maintain its forward movement. The tandem movement of pistons 78 and 86 occurs because pressure passes through passage 84 to passage 98 to act on piston 86. Movement of piston 78 moves tube 88 against piston 86. After piston 78 hits travel stop 92, piston 86 completes its stroke. Near the end of the stroke, ball 122 is displaced from seat 126 removing the available driving force of fluid pressure as piston 86 hits travel stop 120. With the pressure removed from the surface, spring 62 returns the slips 40 to their original position by pushing up piston 56. If it fails to do that, a ball (not shown) is dropped on seat 26 and pressure to a high level is applied to rupture the rupture disc 20 so that piston 56 can be forced up with pressure. When piston 56 is forced up so is piston 59 due to the difference in surface areas between surfaces 75 and 77. Ratchet plug 61 is pushed up against spring 63 as fluid is displaced outwardly through passage 65. Ratchet teeth 79 and 81 lock to prevent downward movement of piston 56. If more of casing or tubing 136 needs to be expanded, weight is set down to return the force-magnifying tool 66 to the run in position shown in FIG. 3 and the entire cycle is repeated until the entire section is repeated to the desired diameter with the swage 134.

Those skilled in the art can see that the force-magnifying tool 66 can be configured to have any number of pistons moving in tandem for achieving the desired pushing force on the swage 134. Optionally, the swage can be moved with no force magnification. The nature of the anchor device 10 can be varied and only the preferred embodiment is illustrated. The provision of an adjacent anchor to the section of casing or tubular being repaired facilitates the repair because reliance on surface manipulation of the string, when making such repairs is no longer necessary. Multiple trips are not required because sufficient force can be delivered to expand to the desired finished diameter with a swage such as 134. Even greater versatility is available if the swage diameter can be varied downhole. With this feature, if going to the maximum diameter in a single pass proves problematic, the diameter of the swage can be reduced to bring it through at a lesser diameter followed by a repetition of the process with the swage then adjusted to an incrementally larger diameter. Optionally the anchor 10 can also include centralizers 138 and 140. A single or multiple cones or other camming techniques can guide out the slips 40. Spring 63 can be a bowed snap ring or a coiled spring. Slips 40 can have inserts 42 or other types of surface treatment to promote grip into the casing or tubular.

Figure 5A:
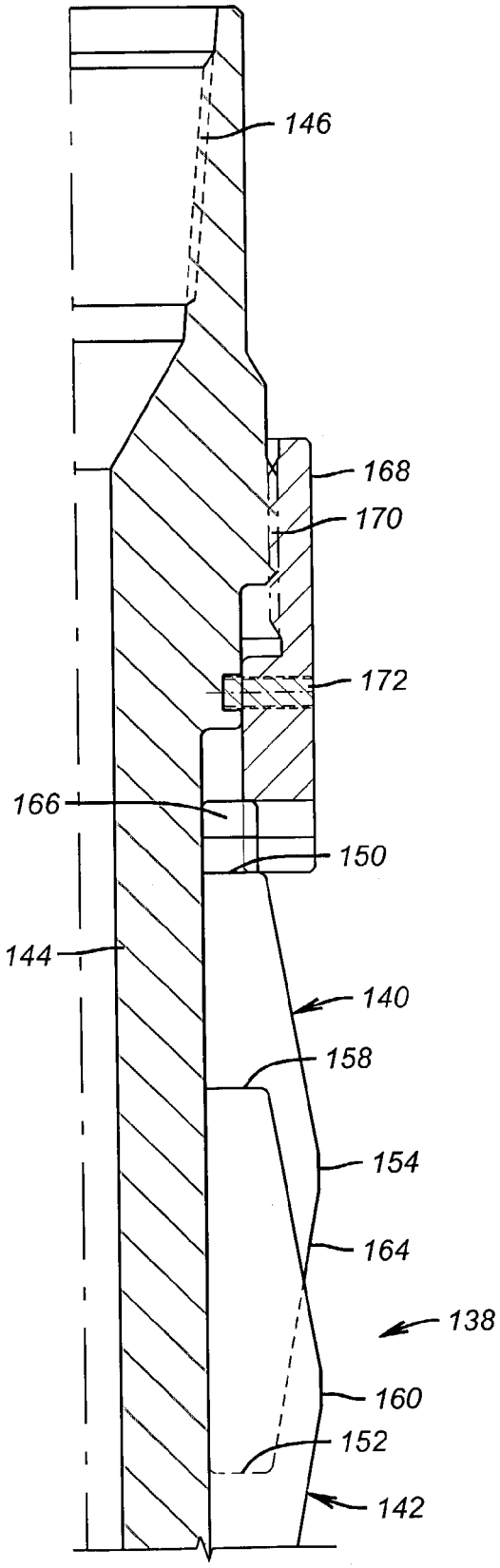
FIGS. 5*a*–5*c* are a sectional elevation view of the optional adjustable swage shown in the run in position.
Figure 5B:
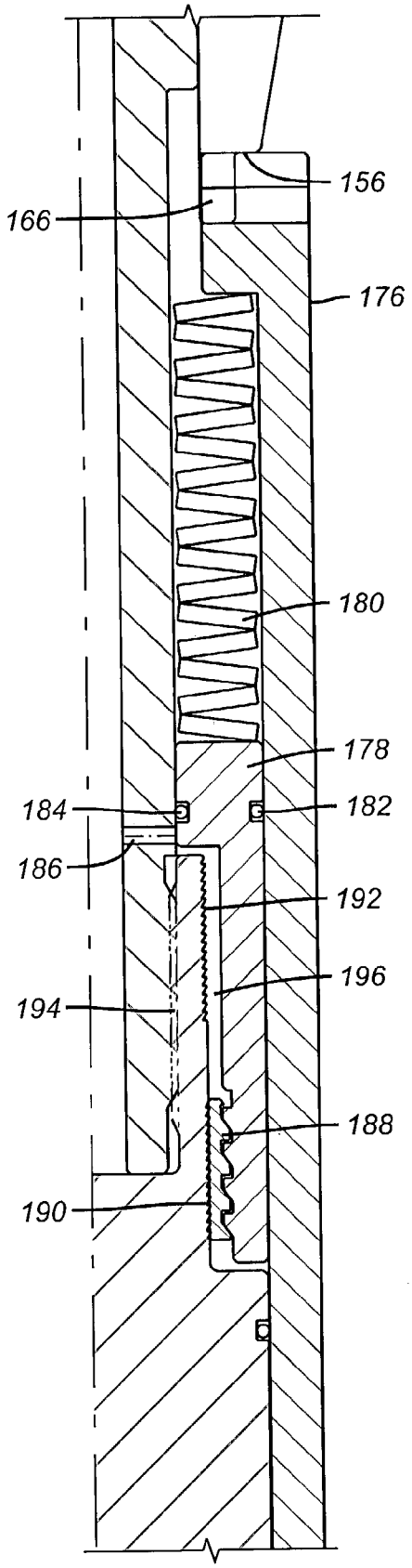
Figure 5C:
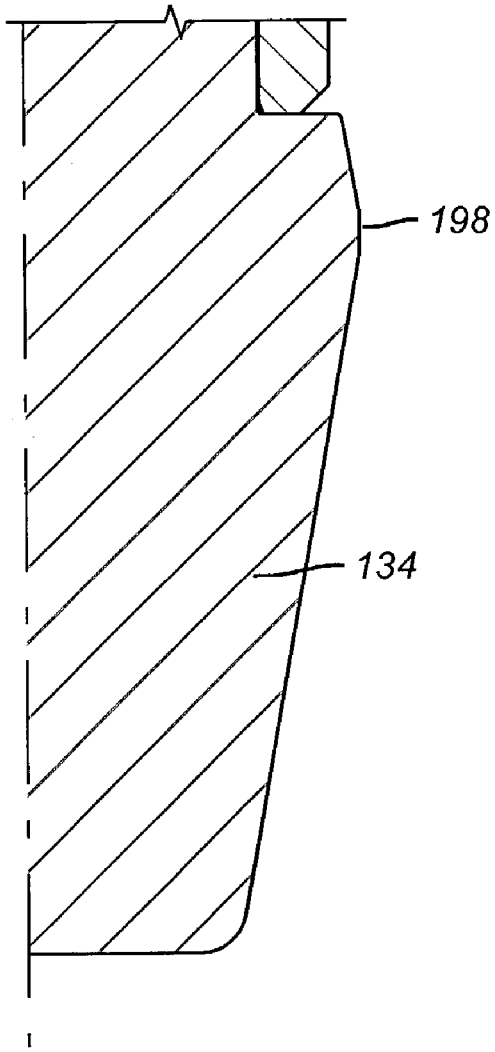
Figure 6C:
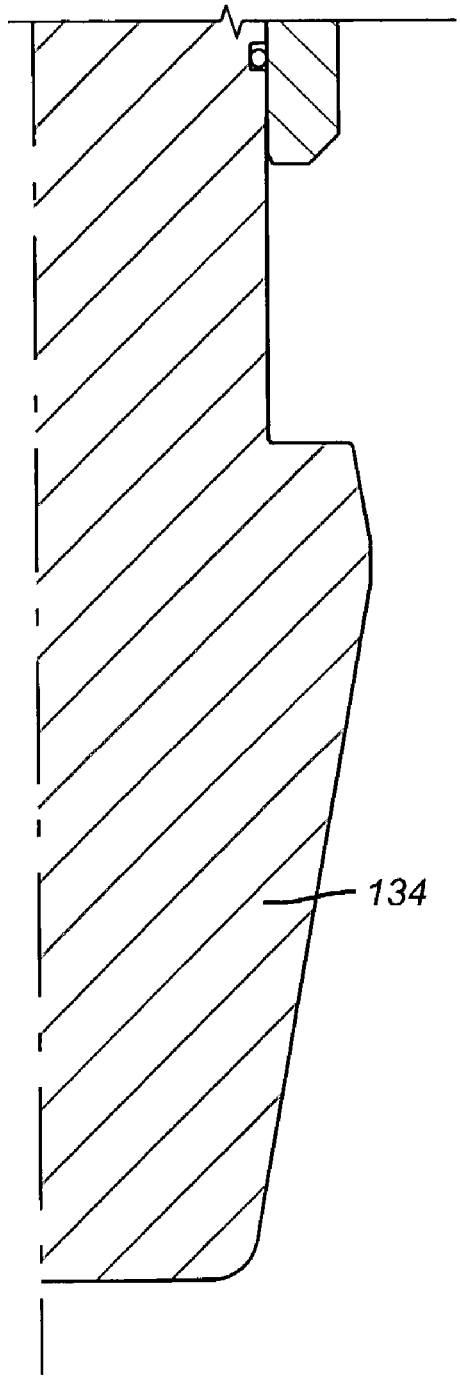
Figure 8:
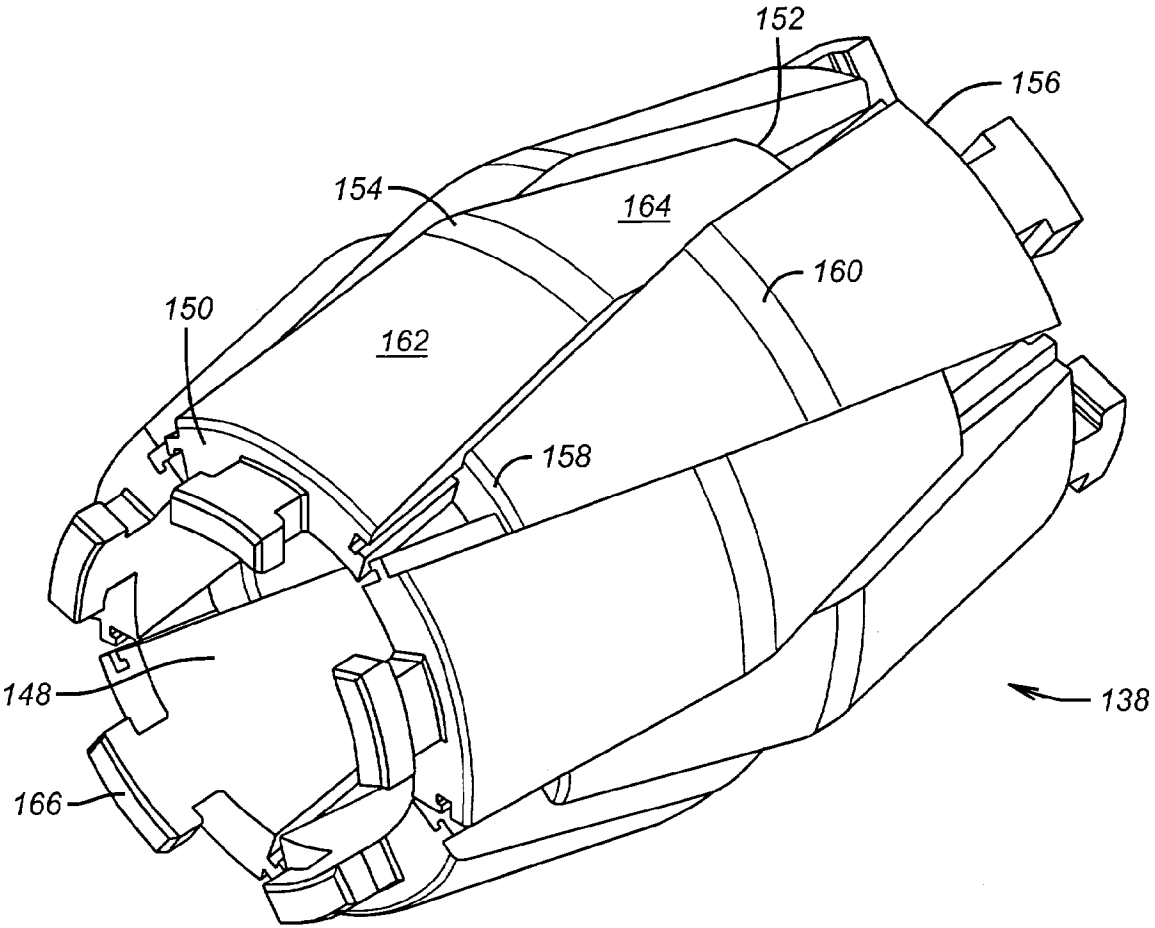

Additional flexibility can be achieved by using flexible swage 138. FIG. 8 shows it in perspective and FIGS. 5*a*–5*c* show how it is installed above a fixed swage 134. The adjustable swage 138 comprises a series of alternating upper segments 140 and lower segments 142. The segments 140 and 142 are mounted for relative, preferably slidable, movement. Each segment, 140 for example, is dovetailed into an adjacent segment 142 on both sides. The dovetailing can have a variety of shapes in cross-section, however an L shape is preferred with one side having a protruding L shape and the opposite side of that segment having a recessed L shape so that all the segments 140 and 142 can form the requisite swage structure for 360 degrees around mandrel 144. Mandrel 144 has a thread 146 to connect, through another sub (not shown) to thread 130 shown in FIG. 3*e* at the lower end of the pressure magnification tool 66. The opening 148 made by the segments 140 and 142 (see FIG. 8) fits around mandrel 144.

Figure 6A:
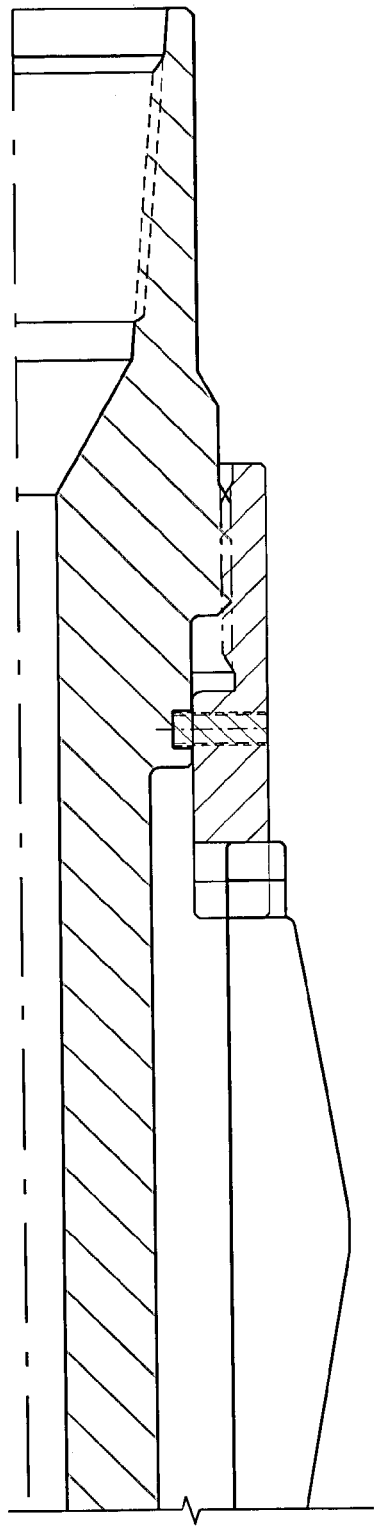
FIGS. 6*a*–6*c* are the view of FIGS. 5*a*–5*c* in the maximum diameter position for actual swaging.

Segments 140 have a wide top 150 tapering down to a narrow bottom 152 with a high area 154, in between. Similarly, the oppositely oriented segments 142 have a wide bottom 156 tapering up to a narrow top 158 with a high area 160, in between. The high areas 154 and 160 are preferably identical so that they can be placed in alignment, as shown in FIG. 6*a*. The high areas 154 and 160 can also be lines instead of bands. If band areas are used they can be aligned or askew from the longitudinal axis. The band area surfaces can be flat, rounded, elliptical or other shapes when viewed in section. The preferred embodiment uses band areas aligned with the longitudinal axis and slightly curved. The surfaces leading to and away from the high area, such as 162 and 164 for example can be in a single or multiple inclined planes with respect to the longitudinal axis.

Segments 140 have a preferably T shaped member 166 engaged to ring 168. Ring 168 is connected to mandrel 144 at thread 170. During run in a shear pin 172 holds ring 168 to mandrel 144. Lower segments 142 are retained by T shaped members 174 to ring 176. Ring 176 is biased upwardly by piston 178. The biasing can be done in a variety of ways with a stack of Belleville washers 180 illustrated as one example. Piston 178 has seals 182 and 184 to allow pressure through opening 186 in the mandrel 144 to move up the piston 178 and pre-compress the washers 180. A lock ring 188 has teeth 190 to engage teeth 192 on the fixed swage 134, when the piston 178 is driven up. Thread 194 connects fixed swage 134 to mandrel 144. Opening 186 leads to cavity 196 for driving up piston 178. Preferably, high areas 154 and 160 do not extend out as far as the high area 198 of fixed swage 134 during the run in position shown in FIG. 5. The fixed swage 134 can have the variation in outer surface configuration previously described for the segments 140 and 142.

Figure 6B:
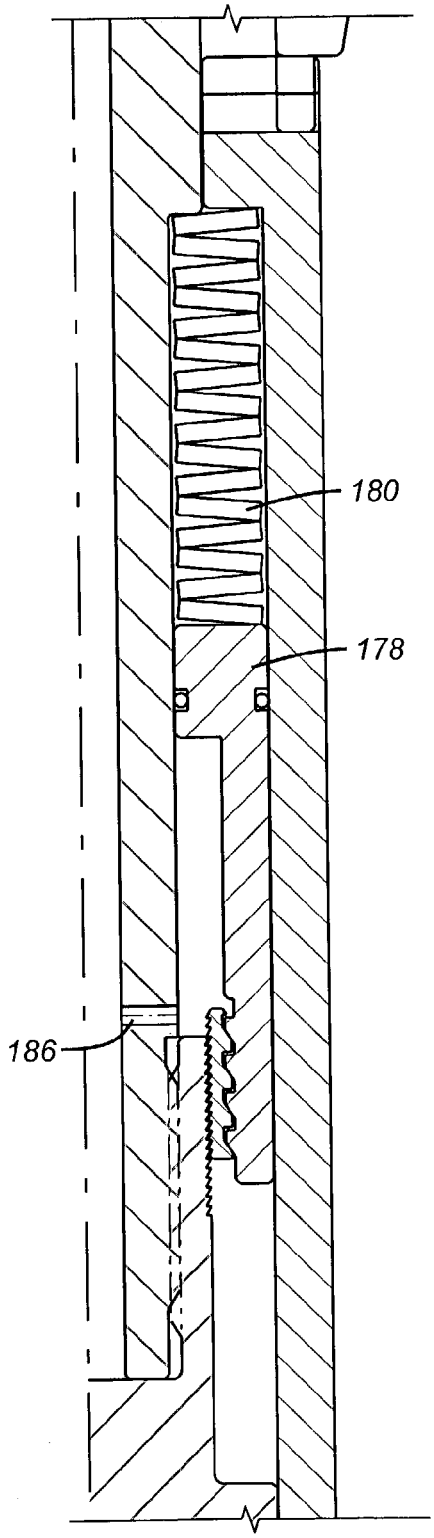
Figure 9:
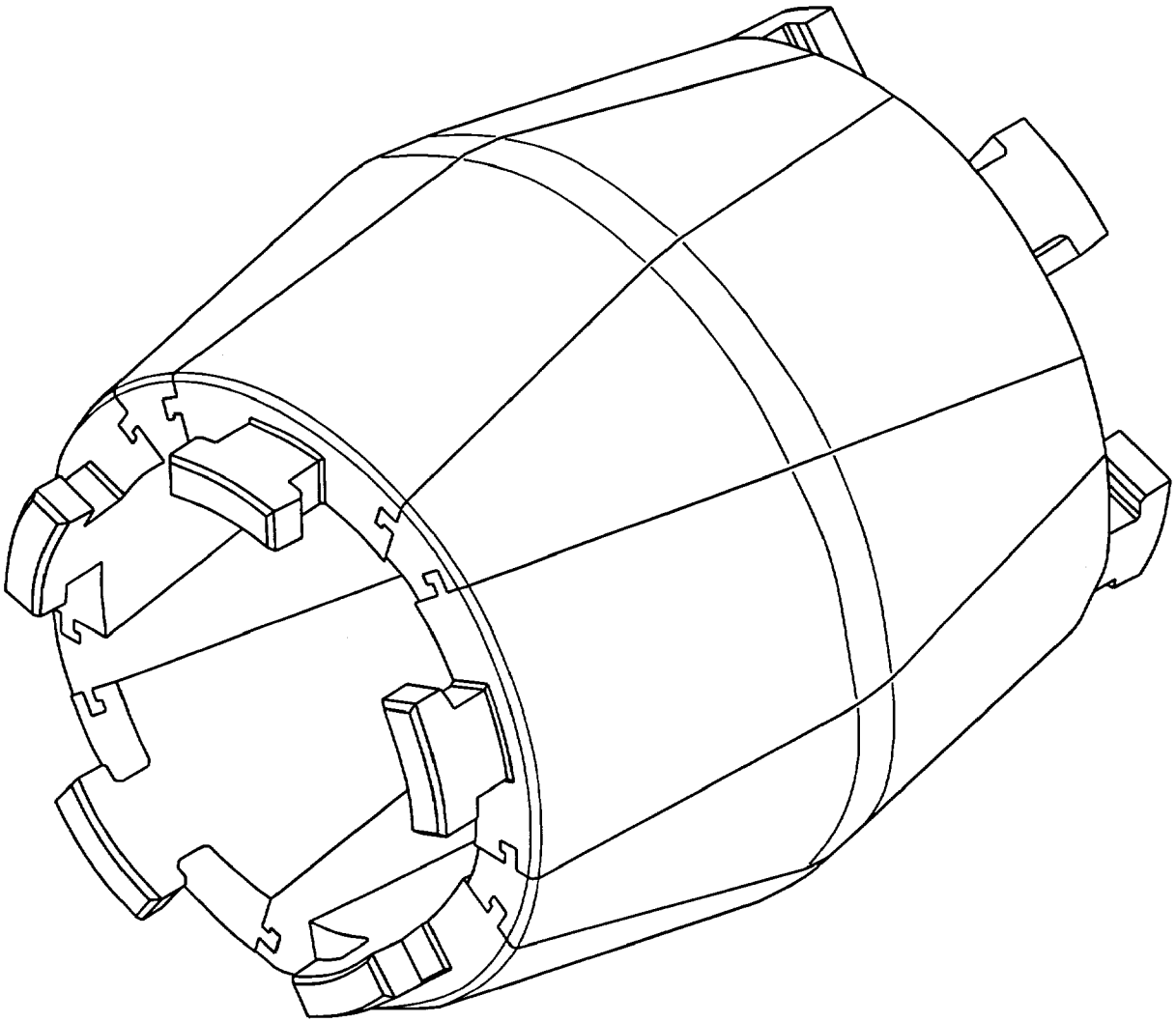
FIG. 9 is a perspective view of the adjustable swage in the maximum diameter position.
Figure 10:
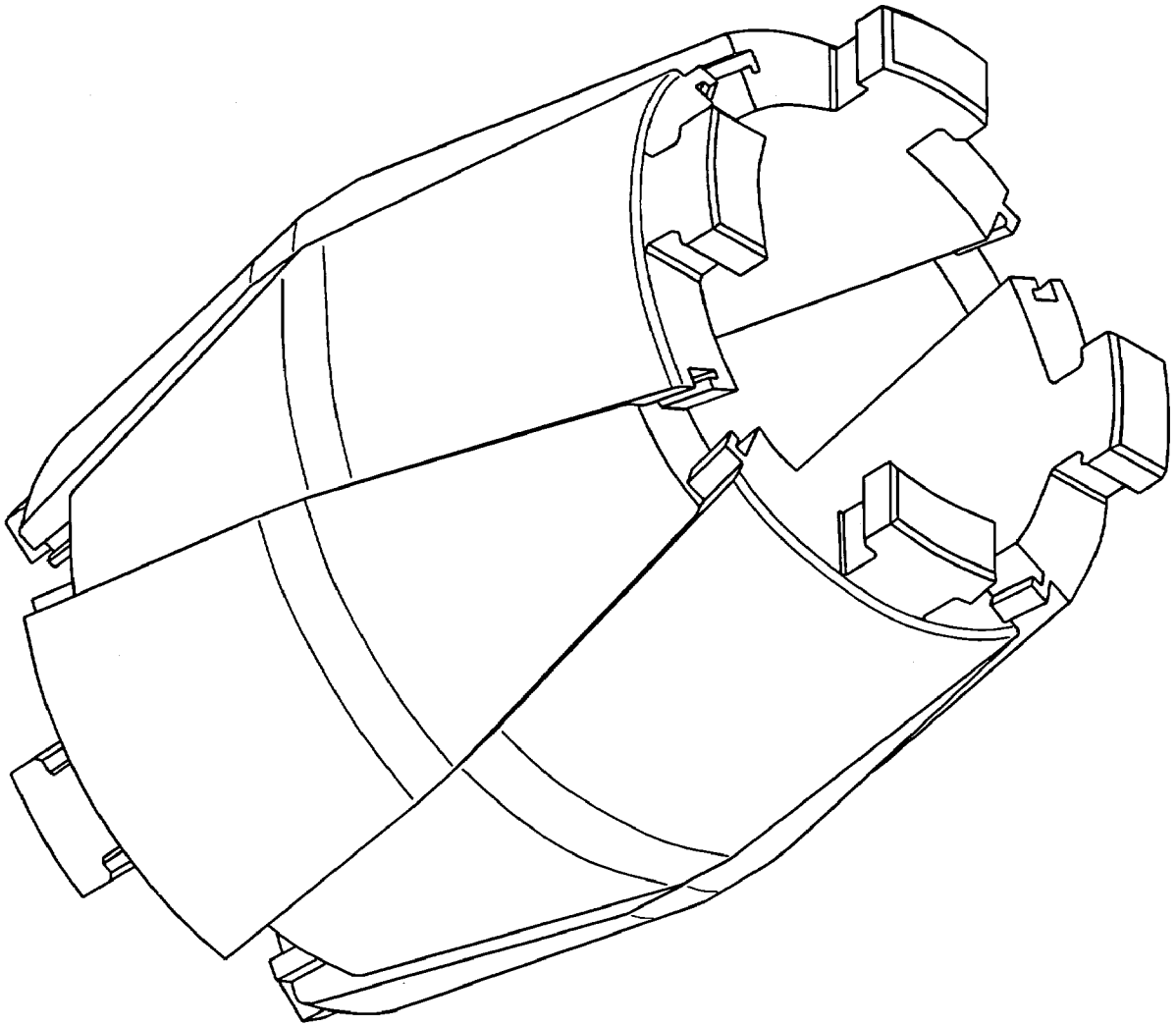
FIG. 10 is a perspective view of the adjustable swage in the pulling out of the hole position.

The operation of the method using the flexible swage 138 will now be described. The assembly of the anchor 10, the force magnifying tool 66, the flexible swage 138 shown in the run in position of FIG. 5, and the fixed swage 134 are advanced to the location of a collapsed or damaged casing 133 until the swage 134 makes contact (see FIG. 4). At first, an attempt to set down weight could be tried to see if swage 134 could go through the damaged portion of the casing 133. If this fails to work, pressure is applied from the surface. This applied pressure could force swage 134 through the obstruction by repeated stroking as described above. If the fixed swage 134 goes through the obstruction, the flexible swage could then land on the obstruction and then be expanded and driven through it, as explained below. As previously explained, the slips 40 of anchor 10 take a grip. Additionally, pressure from the surface can start the pistons 78 and 86 moving in the force magnification tool 66. Finally, pressure from the surface enters opening 186 and forces piston 178 to compress washers 180, as shown in FIG. 6*b*. Lower segments 142 rise in tandem with piston 178 and ring 176 until no further uphole movement is possible. This can be defined by the contact of the segments 140 and 142 with the casing or tubular 133. This contact may occur at full extension illustrated in FIG. 6*b* or 9, or it may occur short of attaining that position. The full extension position is defined by alignment of high areas 154 and 160. Washers 180 apply a bias to the lower segments 142 in an upward direction and that bias is locked in by lock ring 188 as teeth 190 and 192 engage as a result of movement of piston 178. At this point, downward stroking from the force magnification tool 66 forces the swage downwardly. The friction force acting on lower segments 142 augments the bias of washers 180 as the flexible swage 138 is driven down. This tends to keep the flexible swage at its maximum diameter for 360 degree swaging of the casing or tubular 133. The upper segments do not affect the load on the washers 180 when moving the flexible swage 138 up or down in the well, in the position shown in FIG. 6*a*.

Figure 7A:
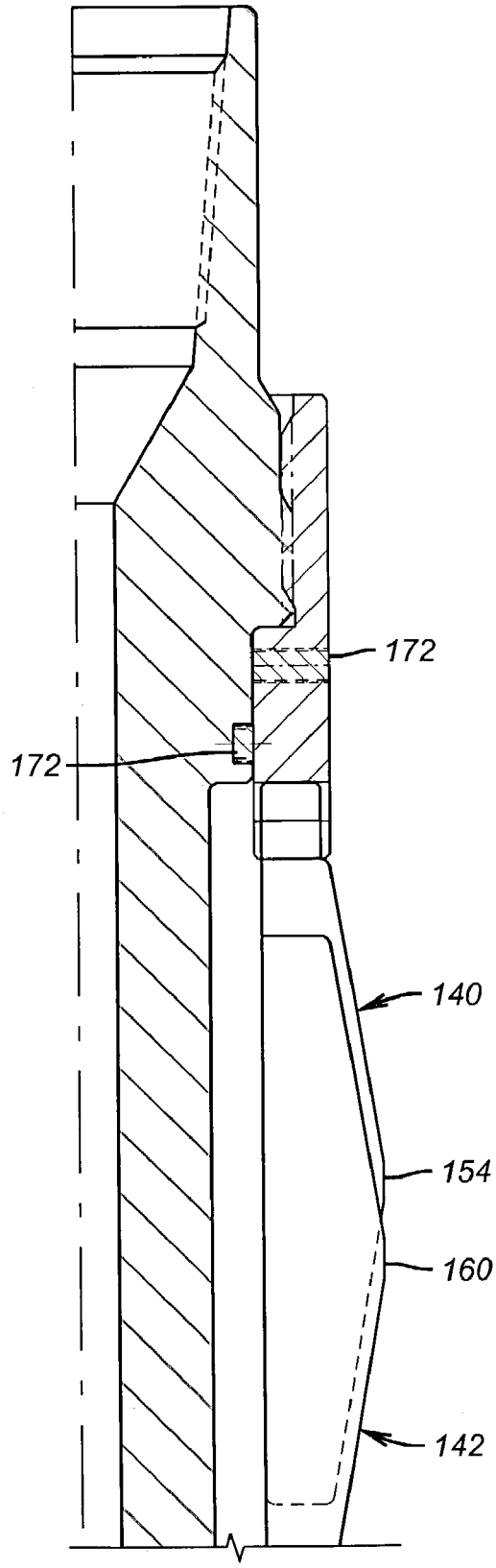
FIGS. 7*a*–7*c* are the views of FIGS. 6*a*–6*c* shown in the pulling out position after swaging
Figure 7B:
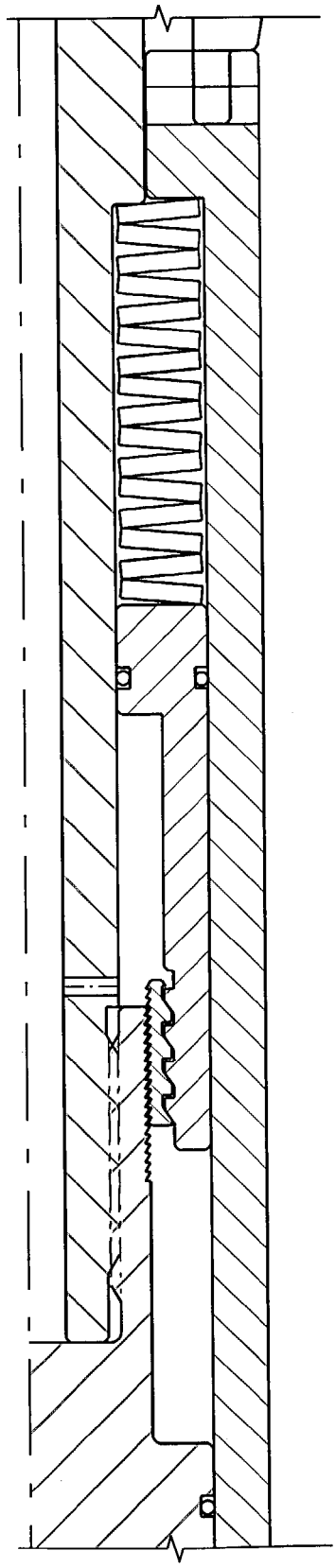
Figure 7C:
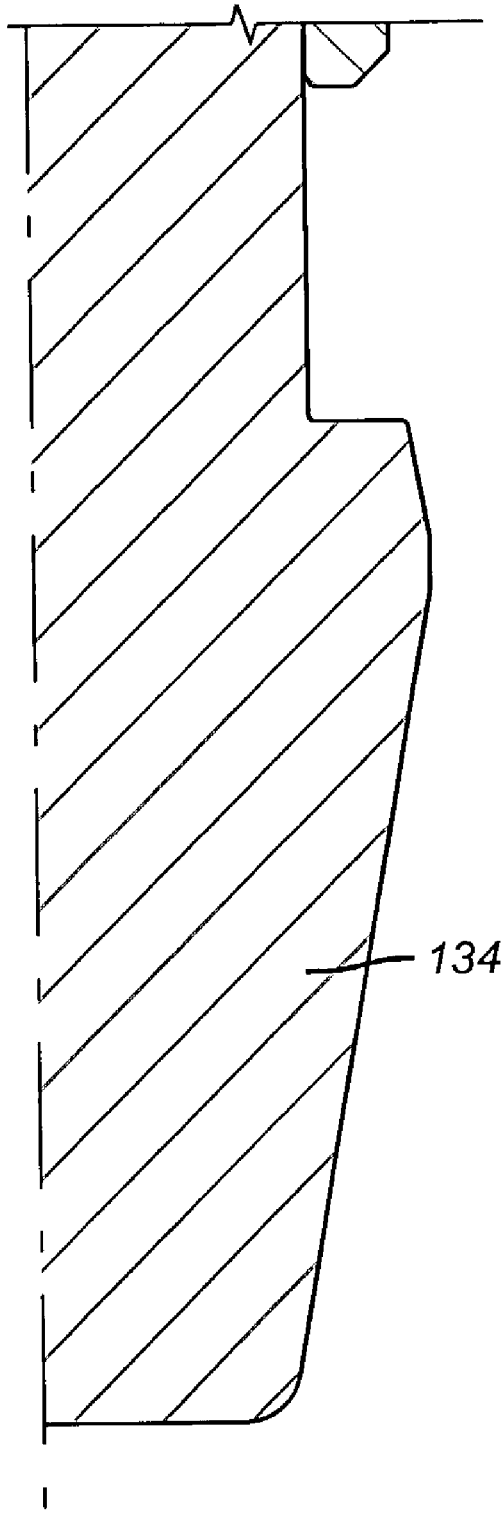

When it is time to come out of the hole it will be desirable to offset the alignment of the high areas 154 and 160. When aligned, these high areas exceed the nominal inside diameter of the casing or tubing 133 by about 0.150 inches or more. To avoid having to pull under load to get out of the hole, the mandrel 144 can be turned to the right. This will shear the pin 172 as shown in FIG. 7*a*. Ring 168 will rise, taking with it the upper segments 140. High areas 154 and 160 will be offset and at a sufficiently reduced diameter due to this movement to be brought out of the casing or tubing without expanding it on the way out. The reason the dimension on full alignment of high areas 154 and 160 exceeds the nominal casing or tubing inside diameter is that the casing or tubing 133 has a memory and bounces back after expansion. The objective is to have the final inside diameter be at least the original nominal value. Therefore the expansion with the flexible swage 138 has to go about 0.150 inches beyond the desired end dimension. The angled configuration of the segments, which interlock on a straight track allows the desired outer diameter variation and could be configured for other desired differentials between the smallest diameter for run in and the largest diameter for swaging. It should be noted that the swaging could begin at a diameter less than that shown in FIGS. 6*a* or 9. The swaging diameter can grow as the swaging progresses due to the combined forces of washers 180, friction forces on surfaces 164 and the condition of the casing or tubular 133.

Those skilled in the art will appreciate that swaging can be done going uphole rather than downhole; if the flexible swage 138 shown in FIG. 5 is inverted above the fixed swage 134. The flexible swage 138 can be used in the described method or in other methods for swaging downhole using other associated equipment or simply the equipment shown in FIG. 5. The advantages of full 360 degree swaging at variable diameters makes the flexible swage 138 an improvement over past spring or arm mounted roller swages, which had the tendency to cold work the pipe too much and cause cracking. The collet type swages would not always uniformly extend around the 360 degree periphery of the inner wall of the casing or tubular causing parallel stripes of expanded and unexpanded zones with the potential of cracks forming at the transitions. The interlocking or side guiding of the segments 140 and 142 presents a more reliable way to swage around 360 degrees and provides for simple run in and tripping out of the hole. It can also allow for expansions beyond the nominal inside dimension, with the ability to trip out quickly while not having to do any expanding on the way in or out.

The foregoing disclosure and description of the invention are illustrative and explanatory thereof, and various changes in the size, shape and materials, as well as in the details of the illustrated construction, may be made without departing from the spirit of the invention.

We claim:

1. An adjustable swage for use on a downhole tubular, comprising:

a rounded body comprising of non-cantilevered segments mounted to a mandrel wherein said segments are movable into a plurality of positions to create a variety of substantially continuous circumferences at a high segment of said body.

2. An adjustable swage for use on a downhole tubular, comprising:

a rounded body mounted to a mandrel wherein said body is movable into a plurality of positions to create a variety of substantially continuous circumferences at a high segment of said body;

said substantially continuous circumferences extend for a full 360°;

said body is formed of a plurality of abutting segments movable with respect to each other.

3. The swage of claim 2, wherein:

said mandrel has a longitudinal axis and said segments slide relatively to each other in the direction of said longitudinal axis.

4. The swage of claim 3, wherein:

said segments are retained to each other while moving relatively to each other in a longitudinal direction.

5. The swage of claim 4, wherein:

said segments are retained to each other at their abutting edges by a tongue and groove connection.

6. An adjustable swage for use on a downhole tubular, comprising:

a rounded body mounted to a mandrel wherein said body is movable into a plurality of positions to create a variety of substantially continuous circumferences;

said substantially continuous circumferences extend for a full 360°;

said body is formed of a plurality of abutting segments movable with respect to each other;

said segments each comprise a high location and at least some of said segments are movable to selectively align said high locations to obtain a maximum diameter or to offset them to attain a minimum diameter.

7. An adjustable swage for use on a downhole tubular, comprising:

a rounded body mounted to a mandrel wherein said body is movable into a plurality of positions to create a variety of substantially continuous circumferences at a high segment of said body;

said substantially continuous circumferences extend for a full 360°;

said body is formed of a plurality of abutting segments movable with respect to each other;

said segments are wedge shaped having a narrow end and a wide end and are arranged in an alternating pattern where the narrow end of one segment, in a first orientation, is adjacent the wide end of a neighboring segment, in a second orientation, on either side.

8. An adjustable swage for use on a downhole tubular, comprising:

a rounded body mounted to a mandrel wherein said body is movable into a plurality of positions to create a variety of substantially continuous circumferences;

said substantially continuous circumferences extend for a full 360°;

said body is formed of a plurality of abutting segments movable with respect to each other;

said segments are wedge shaped having a narrow end and a wide end and are arranged in an alternating pattern where the narrow end of one segment, in a first orientation, is adjacent the wide end of a neighboring segment, in a second orientation, on either side;

said segments in one of said first and second orientations is selectively held fixed and said segments in the other of said first and second orientations is movable.

9. The swage of claim 8, wherein:

said segments each comprise a high location and at least some of said segments are movable to selectively align said high locations to obtain a maximum diameter or to offset them to attain a minimum diameter.

10. The swage of claim 9, wherein:

said movable segments are biased in the direction to obtain said maximum diameter.

11. The swage of claim 10, wherein:

said movable segments are driven as well as biased in the direction to obtain said maximum diameter.

12. The swage of claim 11, wherein:

said movement of said movable segments toward said maximum diameter is in conjunction with a ratchet which prevents said movable segments from movement in a reversed direction.

13. The swage of claim 12, wherein:

said segments that are held fixed are secured to a ring, whereupon relative rotation between said ring and said mandrel moves said segments formerly held fixed away from said movable segments to allow said body to move toward said minimum diameter.

14. The swage of claim 11, wherein:

said movable segments are driven by a piston driven by fluid pressure applied to it through said mandrel; and said bias is provided by a stack of Belleville washers.

15. The swage of claim 9, wherein:

said mandrel has a longitudinal axis and said segments slide relatively to each other in the direction of said longitudinal axis.

16. The swage of claim 15, wherein:

said segments are retained to each other while moving relatively to each other in a longitudinal direction.

17. The swage of claim 16, wherein:

said segments are retained to each other at their abutting edges by a tongue and groove connection.

* * * * *